United States Patent [19]

Bixler et al.

[11] 4,394,214

[45] Jul. 19, 1983

[54] CONSTRUCTION OF UNIVERSAL EGG CELL CUSHION AND METHOD

[75] Inventors: Kenneth D. Bixler, Huntington, N.Y.; Henry A. Lord, Cape Elizabeth, Me.; Richard F. Reifers, New Canaan, Conn.

[73] Assignee: Diamond International Corporation, New York, N.Y.

[21] Appl. No.: 306,980

[22] Filed: Sep. 29, 1981

[51] Int. Cl.[3] ..... D21J 7/00

[52] U.S. Cl. ..... 162/228; 162/383; 229/2.5 EC

[58] Field of Search ..... 162/228, 383; 229/2.5 EC

[56] References Cited

U.S. PATENT DOCUMENTS

| | | | |
|---|---|---|---|
| 2,081,740 | 5/1937 | Farnham | 162/383 |
| 3,016,176 | 1/1962 | Reifers et al. | |
| 3,185,615 | 5/1965 | Reifers | 162/228 |
| 3,325,349 | 6/1967 | Reifers | 162/228 |
| 3,767,103 | 10/1973 | Reifers | 229/2.5 EC |
| 4,088,259 | 5/1978 | Sutton | 229/2.5 EC |

FOREIGN PATENT DOCUMENTS

| | | | |
|---|---|---|---|
| 234156 | 6/1961 | Australia | 162/383 |

*Primary Examiner*—William F. Smith

*Attorney, Agent, or Firm*—Karl W. Flocks; Sheridan Neimark

[57] ABSTRACT

A new and improved molded egg cell construction and method for its manufacture, wherein the molded egg cell includes a cushion or pillopad on an up-post side wall of the cell which projects inwardly, a thin area formed on the outside of the cell adjacent its bottom which is square, the sides of which are oriented at 45° to the sides and ends of the egg carton incorporating the cell, and in which the bottom is planar on its interior surface but formed with thin areas on the exterior of the bottom, in between which, is a footed formation.

5 Claims, 5 Drawing Figures

CONSTRUCTION OF UNIVERSAL EGG CELL CUSHION AND METHOD

BACKGROUND OF THE INVENTION

This invention relates to a new and improved molded egg cell construction and more particularly to a molded egg cell useful for incorporation in cellular egg trays which may form lower sections of covered egg cartons. The improved molded egg cells are formed with cushions which may be described herein as pillopads. These cushions or pillopads extend inwardly from the side walls of the egg cell and are thin, soft and fragile. They are molded integrally and simultaneously with the molding of the entire egg cell or the entire tray or carton in which they are incorporated and the egg cell material may be of plastic such as polystyrene foam molded by the thermoforming or vacuum forming process or of pulp by sucking the pulp fibres from an aqueous slurry containing the fibres onto a shaped screen which is part of a mold of the character utilized in the pulp molding process. When the cushions or pillowpads are made of molded pulp, they are so thin that they are translucent while the surrounding area of the egg cell of normal thickness is definitely opaque. Other features of the invention are described hereinafter.

This invention also relates to an egg cell construction advantageously capable of accepting and protecting small, medium, large, and extra large eggs.

In the past various shaped egg cells have been incorporated in egg cartons. Some of these prior cells have had preferably plain side walls and some have been reformed by hot pressing which softens the walls and produces thin areas by compressing the material in such areas without reducing the amount of material or without reducing the number of fibres in such areas. Such prior egg cells have not been capable of accepting a full range of egg sizes including small, medium, large and extra large eggs and, at the same time, protecting the eggs to the extent deemed essential for economical operation. Examples of prior egg cell constructions are illustrated in the following U.S. Pat. Nos.

Cox—2,771,233, Brichner et al—3,093,286, Reifers et al—3,185,370, Reifers et al—3,207,409, Donaldson—3,643,855, and Reifers et al—4,025,038.

SUMMARY OF THE INVENTION

In accordance with the invention egg cells are efficiently and economically provided which accommodate hen eggs of various sizes and shapes, including those commercially known as small, medium, large and extra large, and afford protection to the extent deemed essential, and indeed required, by those engaged in egg packing operations.

It is an object of the instant invention to teach a novel method of producing a new and improved or universal egg cell capable of accepting hen eggs of various sizes and shapes as occur in the commercial grading of the eggs.

It is another object of the invention to provide molded egg cells with translucent cushions or pillowpads extending inwardly from its side walls.

It is a further object of the invention to provide molded egg cells with soft fragile inwardly projecting bubbles or cushions or pillowpads which flex easily when larger eggs are loaded, whereby the bubbles or cushions or pillopads progressively collapse to the extent required to provide up to the maximum egg room, whereupon the surface of the egg contacts, and is protected by, the peripheral relatively rigid structure which serves as the boundary of the egg cell.

It is still another object to provide additional thin areas in the egg cell by molding such areas of less material on the cell exterior while maintaining a smooth unchanged surface on the cell interior corresponding to such areas.

The foregoing and other objects and advantages will become apparent, and the invention will be better understood from the following description.

DETAILED DESCRIPTION OF THE INVENTION

Figure 1:
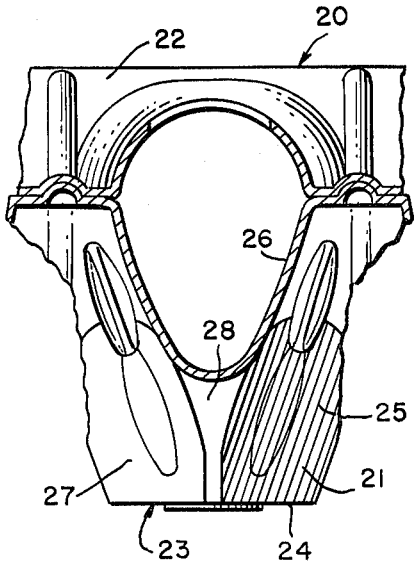
FIG. 1 is a fragmentary longitudinal vertical section, with portions in elevation, through an egg carton incorporating egg cell construction in accordance with the invention.

Referring to FIG. 1, the fragmentary carton portion 20 includes a tray portion 21 below a cover portion 22. The tray 21 is formed with a cell 23 having a configuration generally in accordance with the cell of the U.S. Pat. No. 2,771,233 to Cox. The cell 23 has a square bottom 24 but unlike Cox's cell, the sides of the square are oriented at an angle of 45° to the sides and ends of the carton and not parallel to the sides and ends of the carton. In Cox's carton the sides of cell forming the adjacent up-posts are mainly conical, whereas in the cell 23, the sides which form the up-posts 32 are mainly planar, though in both Cox's cell and cell 23, the lowermost portion 25 is planar and the uppermost portion 26 is generally conical. This unusual, novel, and advantageous effect results from the 45° orientation of the cell 23. In cell 23 the planar portion of the cell side wall is designated by the reference numeral 27 and the general conical portion of the cell side wall is designated by the reference numeral 28.

Figure 2:
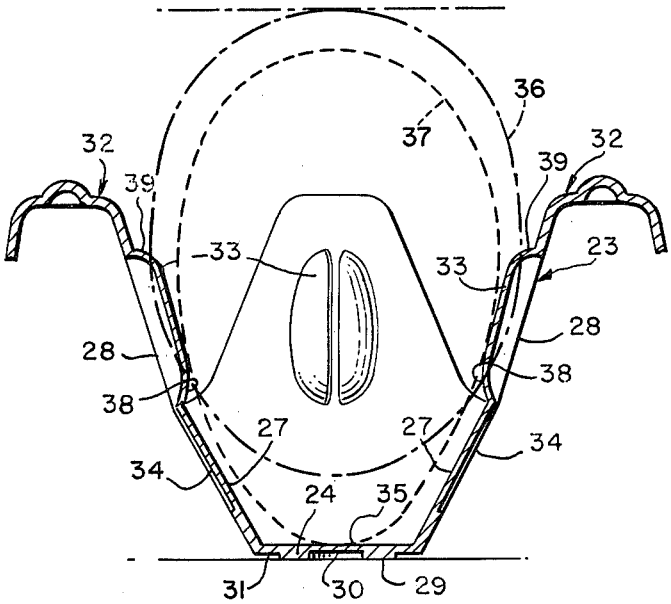
FIG. 2 is a schematic showing of an egg cell in vertical section illustrating the characteristics of the cushion or pillopad on the upper portion of the interior of the cell and other thin areas in the lower portions of the cell and the bottom of the cell.

Referring to FIG. 2 wherein is schematically illustrated eggs of different sizes in the cell 23, the structure of the cell 23 includes a square bottom 24 provided with a circular or annular foot 29 within which is a central portion or thin area 30, and about which is a peripheral thin area 31. Extending upwardly and outwardly from the bottom 24 are the generally planar portions 27 to the generally conical cell side wall portions 28. Extending downwardly from near the top of the up-post 32 are the thin, flexible, deformable, shock-absorbing, translucent cushions or pillopads 33 which traversed or extend over the upper post of the cell side wall conical portion 28 to the down-post of the generally planar cell side wall portions 27. Immediately below the cushions or pillopads 33 are located the thin walled areas 34 in the planar cell side wall portions 27. The interior surface 35 of the cell bottom is flat as the thin walled areas 30 and 31 are formed on the exterior of the cell bottom 24.

In the schematic view of FIG. 2, for purposes of illustration, the outlines of two eggs are shown in relation to the side walls of the cell 23. The lines which represent the egg 36 illustrate an egg of larger girth, or a fat egg. The lines 37 which represent an egg of lesser girth, or smaller, or thinner egg, or skinny egg, are also illustrated in relation to the side walls of the egg cell 23. The fatter egg 36 contact area is confined by the cushions or pillopads are shown to contact the thin walled areas of 34 in the side walls of the cell 23 and also the thin area 30 in the cell bottom 24. When eggs are commercially loaded into the egg cell 23, they are not, as when inserted manually by hand, gently placed in the egg cell. The commercial loading of eggs into egg cartons involves the dropping of the egg from mechanical egg holders, and usually an entire row of eggs is dropped simultaneously from egg holders into a line or row of egg cells. The egg holders receive the commercially graded eggs which which have already been washed and candled. Normally, a commercial grade involves individual eggs of substantially uniform weight without regard for whether the individual egg is fat or skinny. However, the egg carton manufacturer provides cartons with uniform cells which in the past have not entirely related to the variances in the girth of eggs commercially graded as small, medium, large and extra large. Accordingly, with this generally problem existence, the egg cell 23 has been constructed in a novel and improved manner to accommodate not only eggs of various commercial grades but also fat and skinny eggs within a single commercial grade.

In operation, when a fat egg is loaded by dropping it into the cell 23, it is engaged at its girth by the cushion or pillopad 33 and may not touch the cell bottom 24. The fat egg may land in the cell 23 with such force that it partially collapses the shock-absorbing flexible, thin cushion or pillopad 33. In addition, when the carton is closed automatically, if the fat egg has not moved into its proper position in the cell 23, the cover 22 will move the fat egg into its proper position in the cell 23.

When a skinny egg is loaded by dropping it into the cell 23, it may be engaged at its periphery by the thin areas 34 of the side walls of the cell 32 and the thin area 30 in the cell bottom 24 which is surrounded by the relatively strong circular or annular foot 29.

The cushion or pillopad 33 is arranged in the egg cell 23 so that in a vertical direction it traverses the uppermost conical portion 28 of the up-post 32 and extends into the lowermost planar portion 27 of the up-post 32. In the egg cells of the character of egg cell 23, the lower extension of the cushion or pillopad 33 will confine small and medium eggs against improper movement and the upper portion of the cushion or pillopad 33 will confine large and extra large commercial egg sizes.

The vertical length of the pillopad is of $\frac{3}{8}''$ to $\frac{7}{8}''$ and it is preferred that the vertical length be between 10/16" and 13/16". The width of the cushion or pillopad 33 is from 3/16" to 8/16 41 , and the preferred arrangement is between 4/16" and 7/16". The dimension of projection into the egg cell from the side walls thereof is between 1/16" to 3/16". The wall thickness of the cushion or pillopad is of relatively small dimension. For example, on multi-pulp cartons in which the wall thickness is approximately 0.060", the thickness of the cushion or pillopad 33 would be in the range of 0.005"–0.040", and it is preferred that it be between 0.010" to 0.030". As shown in FIG. 2, the pillowpad extends along the post 32 at an altitude measured from the bottom of the cell, starting about 2/5 of the way up the post and ending about 4/5 of the way up the post. When the cushion or pillopad is formed of plastic foam, its thickness could be greater than that of the pulp cushion or pillopad. In the most preferred arrangement of thickness, the wall of the pillopad 33 would be translucent. This character of translucency is present in accordance with the instant invention when the cushion or pillopad 33 is made of pulp hereinafter described. The translucency of the pillopad or cushion would also be present in a pillopad of plastic foam when it is formed by compression to the extent that all or most of the cells of the foam are eliminated. The cushion or pillopads 33, formed in accordance with the instant invention, are not simply projections which extend outwardly from a post in a direction generally toward the central vertical axis of the egg cell, but the cushion or pillopads must be so formed as to be deformable, and they must not be rigid. The cushions or pillopads 33 must be of themselves shock-absorbant and capable of collapse without interference with the overall strength of the egg cell which must be capable of confining the eggs after the cushion or pillopad is deformed or collapsed or partially collapsed. In a specific form of pillopad or cushion 33 its lowermost portion is tapered downwardly at 38. The upper portion 39 of the cushion or pillopad 33 is rounded off in a direction toward the side wall of the post 32.

Figure 3:
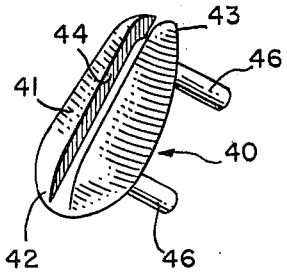
FIG. 3 is an enlarged perspective view of a novel plastic fixture used in the method of manufacture of the cell to produce the cushion formation or pillopad of molded pulp.
Figure 4:
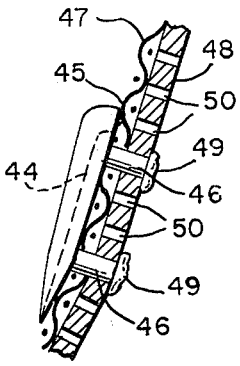
FIG. 4 is a schematic vertical section illustrating how the plastic fixture is attached to the screened form or mold of the character used in the pulp molding process.

Referring to FIGS. 3 and 4, the plastic fixture 40 or cushion form or pillopad form comprises a bubble formation 41 tapered at its lower end 42 and rounded off at its upper end 43. A generally longitudinal groove 44 is centrally formed in the bubble formation 41, and its purpose will be later described in connection with the pulp molding process. On the rear side 45 of the plastic fixture 40 there is provided two spaced rod-like projections 46 which are adapted to extend through the mold screen 47 which overlies the rigid mold base 48. Where the rod-like projections 46 extend through the mold base 48, they are affixed thereto by forming rivet-like-heads 49. This formation of the securing rivet-like-heads 49 may be accomplished with a heated tool such as is known to those in the art of reforming plastic structures. The plastic fixture 40 may also be secured to the screen 47 by an adhesive without resorting to reforming the rod-like projections 46. As a further alternative, the plastic fixture 40 may be secured to the screen by heating the backside 45 of up to or approaching the melting point of the plastic and by the use of pressure causing it to adhere to the screen 47.

Figure 3A:
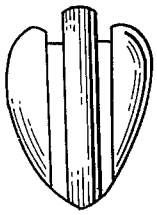
FIG. 3A is an elevational view of another embodiment of the plastic fixture of FIG. 3.

The molded screen 47 is normally the face of the mold which produces the screen side or the smooth side of the molded product. In the case of egg cartons it is normal to produce the screen side on the outside of the carton, and the inside of the carton is referred to in the trade as the bark side. The outside of the egg cell 23 is produced against the screen by utilization of a vacuum source on the side of the base of the mold 48 which is the opposite side from that on which the screen 47 is mounted. The vacuum is sucked through the openings 50 in the mold base 48 and, in turn, through the screen 47. This vacuum causes the fibres from the slurry in contact with the screen to adhere to the screen as the water from the slurry is sucked through the openings 50. The presence of the bubble formation 40 on the screen prevents the normal formation of pulp on the screen and modifies the pulp formation. Ordinarily, when a block-out substance is affixed to the screen, a hole is formed, and it is with the utilization of this procedure that holes are formed in molded pulp products. If it were desired to form a normal wall thickness of pulp in the shape of the cushion or pillopad 33, the plastic fixture would not be utilized and the screen 47 would be formed or shaped to correspond to the shape desired. Accordingly, it will be understood that a block-out form in the shape of the plastic fixture 40 of the size within the preferred range affixed to the screen, in the pulp-molding process, would produce a hole instead of a cushion. The utilization of vacuum in the pulp-molding process would not serve to provide a fibre structure over the surface of the block-out of this size in operation of a commercial molding machine running at operating speeds and under operating conditions. In order to produce the cusion or pillopad 33, there is provided the groove 44 in the bubble formation 41. This groove 44 serves as a path for the vacuum to draw the pulp fibres into the configuration of the cushion or pillopad 33 with the thickness of fibres within the preferred range and over an area within the preferred width and height. When the width of the cushion or pillopad 33 is about 3/16" and 4/16", the groove 44 may be eliminated, and, particularly when the width is greater within than 7/16" or 8/16", two or more generally parallel grooves 44 as shown in FIG. 3A are formed in the cushion or pillopad 33 to stabilize the pulp formation and avoid disadvantageous perforations therein.

Thus, it will be understood that, in accordance with the method of the instant invention, a universal egg cell is provided with a saving of fibre when the egg cell is made of molded pulp. In molded pulp egg cells that have thin areas produced by afterpressing, the saving of pulp is not effected, and the cost is greater because of the additional step of reforming or afterpressing. Should a projection on the inside of a multi-pulp carton cell be made of normal thickness by the normal pulp-molding process on a shaped screen, the projection will be hard and will not serve as a cushion. When the projection on the inside of an egg cell is made of plastic foam by a simple step of thermo-forming or vacuum-forming against a shaped mold, the projection will not be as soft or as flexible or as deformable as it would be without an additional compression step to eliminate or diminish the foam cells, which, when so eliminated or diminished, results in a more flexible area.

In accordance with the instant invention a strong egg cell is provided and, when made of molded pulp, uses less material. Further, in accordance with the invention, eggs are maintained gently against unwanted movement from side to side and breakage is reduced to a minimum. In addition, the cell of the instant invention meets all the automation and shipping requirements.

When attempts are made to provide projections on the inside of a cell with the walls of the projection of normal thickness, the projections are so rigid that only the smaller eggs can be accommodated in cartons incorporating such egg cells which fit normal multi-carton egg cases and, certainly, large and extra large eggs cannot be commercially loaded into such cartons. Another objection to egg cells having projections on their interior of normal thickness is that such cartons cannot be efficiently nested, and such cartons which are not acceptably nestable do not meet commercial requirements.

Attempts to produce inwardly extending projections utilizing the pulp-molding process with block-outs on the screen will result in openings in the projecting formation to permit leakage in such cases when a cracked egg is loaded, and this takes away from marketing appeal.

The lower end of the bubble formation 41 is tapered to produce a corresponding shape 38 on the cushion or pillopad 33. The commercially graded small and medium size eggs rest on the thin areas 34 as well as on the lowermost portion 38 of the cushion or pillopad 33.

The utilization of the cushion or pillopad 33 in the egg cell 23, incorporated into a molded pulp egg carton, reduces the total weight of the carton, reduces the amount of material used therein without weakening the overall carton structure, reduces the energy required to dry the carton and effectively and economically better serves the egg-packing trade.

In an 18-egg cell carton wherein there are three rows of six cells each, with four egg cells surrounding an up-post, each of the four surrounding egg cells may have four cushions or pillopads 33 formed therein. The peripheral rows of cells wherein the egg cells are adjacent the hinge line of a folding carton, or the opposite or front side of such carton, may have two cushion or pillopads therein so as to affort the least obstruction during the closing of the cover of the carton, particularly when the cover is shaped and is non-planar. Corner cells in such an egg carton wherein the cover is non-planar may be provided with a single cushion or pillopad 33.

Molded egg cartons, including egg cells formed with the cushion or pillopad 33 in accordance with the invention efficiently serve the egg packaging trade by providing egg cells which are nestable, and which accommodate not only the range of commercial sizes which are graded by weight but also fat eggs and skinny eggs within any of the commercial grades, including not only the small and medium grades but the large and extra large grades.

In the United States it is popular to place 12 eggs in a $2\times6$ egg carton. The dimensions given above for the cushion or pillopad 33 are related to the egg cells in such popular cartons which fit within the standard egg case. In other situations, where the horizontal dimension from the center of one cell to the center of an adjacent cell is varied, then the dimensions of the cushion or pillopad 33 may also be varied correspondingly. Also to be taken into account is the horizontal dimension of the up-post on which the cushion or pillopad 33 is formed. If, for some reason, this horizontal dimension is varied, then the dimension of the cushion or pillopad may be correspondingly varied.

It will be obvious to those skilled in the art that various changes may be made without departing from the scope of the invention and the invention is not to be considered limited to what is shown in the drawings and described in the specification.

What is claimed is:

1. The method of forming a vertically elongated hollow thin walled cushion or pillopad on a side wall of an egg cell, including fastening to the screen side of the egg cell perforated mold an elongated grooved bubble shaped segment, and sucking, by the application of vacuum, pulp fibres from a pulp slurry on the screen and over the grooved bubble segment to form a relatively thin layer of pulp fibres in relation to the surface of said bubble segment, the vacuum on the side of the screen opposite from the bubble segment side is also present in the groove and serves to insure that fibres form in relation to the surface of said bubble segment.

2. The method of forming a vertically elongated hollow thin walled cushion or pillopad on a side wall of an egg cell in accordance, including fastening to the screen side of the egg cell perforated mold an elongated grooved imperforate bubble shaped segment, and sucking, by the application of vacuum, pulp fibres from a pulp slurry on to the screen and over the imperforate grooved bubble segment to form a relatively thin layer of pulp fibres over said bubble segment and over the groove, the vacuum on the side of the screen opposite from the bubble segment side is also present in the groove and serves to insure that the fibres cover the entire width as well as the length of the bubble so that the cushion or pillopad when formed is imperforate.

3. The method in accordance with claim 1 or claim 2, wherein the bubble segment is first fastened to the mold by at least one generally horizontal extension from the rear side thereof which passes through the mold, which extension is then formed with an enlarged head and then the pulp fibres are sucked over the bubble segment.

4. The method in accordance with claim 1 or claim 2, wherein the bubble segment is fastened to the mold screen with adhesive.

5. The method according to claim 1 or 2 wherein the bubble-shaped segment has at least two grooves therein.

* * * * *